US008302795B2

(12) United States Patent
Van Den Broek et al.

(10) Patent No.: US 8,302,795 B2
(45) Date of Patent: Nov. 6, 2012

(54) CAP FOR BOTTLES WITH BOX FOR POWDER MATERIAL FOR PREPARATION OF BEVERAGES

(75) Inventors: Lucas Karel Johannes Van Den Broek, Zeewolde (NL); Gerard Van Amerongen, Bennekom (NL)

(73) Assignee: Cedevita D.O.O., Zagreb (HR)

( * ) Notice: Subject to any disclaimer, the term of this patent is extended or adjusted under 35 U.S.C. 154(b) by 206 days.

(21) Appl. No.: 12/452,683

(22) PCT Filed: Jun. 20, 2008

(86) PCT No.: PCT/HR2008/000021
§ 371 (c)(1),
(2), (4) Date: Apr. 5, 2010

(87) PCT Pub. No.: WO2009/010809
PCT Pub. Date: Jan. 22, 2009

(65) Prior Publication Data

US 2010/0200536 A1 Aug. 12, 2010

(30) Foreign Application Priority Data

Jul. 16, 2007 (HR) ..... P 20070312 A

(51) Int. Cl.
*B65D 51/18* (2006.01)
*B65D 41/34* (2006.01)

(52) U.S. Cl. ..... 215/257; 215/253; 215/DIG. 8; 220/258.4

(58) Field of Classification Search ..... 215/253, 215/257, DIG. 8; 220/258.4
See application file for complete search history.

(56) References Cited

U.S. PATENT DOCUMENTS

| | | | | |
|---|---|---|---|---|
| 3,968,872 | A | 7/1976 | Cavazza | |
| 6,148,996 | A * | 11/2000 | Morini | 206/222 |
| 7,178,683 | B2 * | 2/2007 | Birkmayer et al. | 215/257 |
| 7,490,736 | B2 * | 2/2009 | Moulton | 222/83 |

(Continued)

FOREIGN PATENT DOCUMENTS

| | | |
|---|---|---|
| CA | 2 410 839 | 2/2004 |

(Continued)

OTHER PUBLICATIONS

International Search Report dated Oct. 9, 2008.

*Primary Examiner* — Mickey Yu
*Assistant Examiner* — Niki Eloshway
(74) *Attorney, Agent, or Firm* — Jacobson Holman PLLC

(57) ABSTRACT

Caps for bottles with a box of powder material for preparation of beverages. The cap is applied to a basic box with a basic substance enclosed, as e.g. drinking water. The cap contains the other box with the other liquid or powder substance. The box is closed on the bottom-side with aluminum foil and a slant damper and on an upper side by a cover. The damper may be twisted around a hinge and have on an upper surface a one-arm vertical flexible lever arranged above the aluminum foil. The cover has on an internal plane bottom tangs, as well as a barrier, by which during winding up and winding off the cover acts on the lever. By winding off the cover a free end of the lever is elastically bent, creating in it a moment of force, which twists the damper and breaks through and removes the aluminum foil. Upon finishing mixing substances, the blend may be drank through the opening of the box.

2 Claims, 4 Drawing Sheets

U.S. PATENT DOCUMENTS

| | | | | |
|---|---|---|---|---|
| 7,562,782 | B2 * | 7/2009 | Yorita | 215/228 |
| 7,607,549 | B2 * | 10/2009 | Morini | 215/297 |
| 7,614,496 | B2 * | 11/2009 | Dvorak et al. | 206/219 |
| 7,896,155 | B2 * | 3/2011 | Seelhofer | 206/222 |
| 7,921,993 | B1 * | 4/2011 | Zammit | 206/222 |
| 2006/0108314 | A1 * | 5/2006 | Cho | 215/228 |
| 2009/0261000 | A1 * | 10/2009 | Epp et al. | 206/222 |

FOREIGN PATENT DOCUMENTS

| | | |
|---|---|---|
| DE | 2 200 484 | 7/1979 |
| FR | 2 424 197 | 11/1979 |
| FR | 2 745 274 | 8/1997 |
| HR | P20030525 | 12/2003 |
| JP | 2001180733 | 7/2001 |
| JP | 200329205 | 10/2003 |
| JP | 2004238022 | 8/2004 |
| JP | 2005022706 | 1/2005 |
| JP | 2005022716 | 1/2005 |
| JP | 2005200100 | 7/2005 |
| JP | 2006027709 | 2/2006 |
| JP | 2006044669 | 2/2006 |
| JP | 2006069636 | 3/2006 |
| JP | 2006131283 | 5/2006 |
| JP | 2007001651 | 1/2007 |
| NL | 7410521 | 2/1975 |
| WO | WO 02/051711 | 7/2002 |
| WO | WO 02/092440 | 11/2002 |
| WO | WO 2004/000667 | 12/2003 |
| WO | WO 2004/033336 | 4/2004 |
| WO | WO 2006/123946 | 11/2006 |

* cited by examiner

CAP FOR BOTTLES WITH BOX FOR POWDER MATERIAL FOR PREPARATION OF BEVERAGES

This is a national stage of PCT/HR08/000,021 filed Jun. 20, 2008 and published in English, which has a priority of Croatia no. P 20070312 A filed Jul. 16, 2007, hereby incorporated by reference.

DESCRIPTION OF THE INVENTION

1. Technical Fields

The invention belongs to the field of caps for boxes for packing food, pharmaceutical and chemical products, obtained by mixing two different substances.

The scope of the invention is the cap with which the first or basic box with the first or basic substance is closed and which contains the other box with the other or additional substance. The first box may contain some liquid substance as e.g. drinking water and the other box which is the integral part of a cap, may contain some liquid or powder substance. Because of usage-characteristics of the blend obtained by mixing substances in boxes, before mixing these substances should be separated and mixed directly before use. The partition wall, dividing two substances, placed at the bottom of the other box is removed by breaking through and tearing by means of a cutter that is activated by the cover of the other box.

According to the seventh edition of International Classification of patents, the invention belongs to fields of technique indicated with marks:

B65D51/28—caps with auxiliary boxes for additional things or material,

B65D47/36—caps with devices for filling and emptying or for emptying with fragile parts adjusted for breaking through, tearing or taking down for emptying.

2. Technical Problem

On the basis of the search of patents in the base esp@cenet described in detail in the next chapter, it was established that finding constructional solutions of a cap by which the basic box with the basic substance, containing the other box with the other or additional substance is closed, represents technical problem intensively solved in the world in the last 40 years. The essence of technical problem of all known solutions comes down to finding a constructional solution of functional and cost-effective mechanism for removing partition between the first and the second box by which power and motion are transmitted from the manually activated member of a mechanism to the cutting member of that mechanism. Technical solution contained in this invention represents the new solution, by which this existing technical problem is solved.

BACKGROUND ART

On the modern world market of food, pharmaceutical and chemical products as specific segments of the world market for application of this type of packing products there does not exist any known solution of the described technical problem taking significant place in the world.

In course of preparation for drawing up the patent application for this invention, in June 2007 the search of patents in the base esp@cenet in the world patent fund, containing this base, took place. The search of patent documents was performed in the fields B65D51/28 and B65D47/36 of the International Classification of patents. By the search of patent documents classified to the field B65D51/28 and the field B65D47/36 of the International Classification of Patents it was established that at the time of searching in the base esp@cenet there existed 53 patent documents classified to both mentioned field of technique.

The time period of development of these solutions encloses the period from 1967 till 2007 and contents of these solutions point at the development way from simple to very complex solutions that may be divided in three groups.

The first group of solutions encloses those solutions in which manually activated member of a mechanism or its part in breaking through, tearing or taking down the partition moves axially towards the partition, carrying out only translatory motion or complex translatory and rotational motion. The cutting members carry out also one of mentioned motions in relation to the partition which is fixed. This group encloses solutions described in patent documents No. WO02092440, JP2007001651, WO2006123946, JP2006131283, JP2006508866T, JP2006069636, JP2006044669, JP2006027709, JP2005022716, JP2005022706, JP2001180733, FR2745274, FR2424197, NL7410521 and DE2200484. This is the group of simpliest solutions but of most complex procedure of use. In order to make a blend of two substances it is firstly necessary to remove the partition between them and then to open the box with a blend and to use the blend, for which it is necessary to have knowledge of constructional system of the solution itself or procedure by exactly determined order of laid down manipulation. This group of solutions includes also the solution described in the document HR20030525 of the applicant of this patent application.

The second group of solutions include solutions described in patent documents No. JP2005200100, CA2410839 and JP2003292059. In these solutions the partition between the first and second box makes only a rigid detachable bottom of the other box which on its periphery may have flexibly pliable teeth. Connection of the other box and its bottom is made as the spring joint or connection through thinned shell wall of the other box. The top of the other box is connected and closed with the cover of the other box, which closes the first box. Filled in first box is inserted through the neck of the first box by winding up the cap with the other box on the neck opening of the first box until flexible teeth on periphery of the bottom of other box pass below the lower edge of the neck of the first box or the other element used as removing element, and broaden below it. When winding off the cover with the other box, the edge of a neck of the first box or other element used as element for removing the bottom of other box retains the bottom of the other box, whereby the bond between the second box and its bottom falling in the first box tears off, upon which mixing of components in boxes takes place. Joint of the other box and its bottom is a critical detail of this group of solutions, because this joint should be reliably impermeable and easily detachable which are in constructional sense two contradictory claims.

Third group of solutions includes solutions described in patent documents No. WO2004000667 and WO2004033336. Both solutions are characterized by simple way of use, because the procedure of use consists only of winding off the cap of other box, whereby cutting member opens the partition between boxes. By winding off the cap of other box, cutting member is activated through relatively complex mechanism for transmission of powers and motions.

The cap described in the patent document No. WO2004000667 consists of three parts: the medium fixed body by which the cap is fastened to the first box, cover that is wound up to the upper part of fixed part and annular cutting member inserted in the medium part of the cap. By winding off the cap, the annular cutting member guided in the medium part is activated, so that the cutting member firstly carries out linear motion towards the partition which is broken through by its peaked part and then circular motion for 360°, whereby it cuts out the partition in the whole. Conversion of motion of the cover on the helix in linear and circular motion of cutting member is done through the complex system of inclinations, guides and stoppers made on all three parts of the mechanism, which significantly raises the price of manufacturing tools for their injecting.

The cap described in the patent document No. WO2004033336 is also multipart mechanism which cutting member consists of hinge mechanism which is activated by winding off the cover. In this embodiment the simplicity of use is achieved by complex and expensive cap.

ESSENCE OF THE INVENTION

The cap according to the invention consists of box of the cap and its cover of simple embodiment.

Box of the cap has basically the form of a pipe having on the lower end the form of double cylinder. On the internal shell of the external cylinder there are threads for winding up box of the cap to the opening of the first box and on the edge of the opening of the internal cylinder there is aluminium foil which is impermeably glued on the edge itself of the opening and a part of the external shell of the internal cylinder. On the external cylinder of the upper end of the box of the cap there are threads for winding up the cover of the box. In the interior of the box of the cap there is the cutting member in form of a slant damper put above the aluminium foil. The damper under sharp angle in relation to the horizontal plane closes in the whole the internal cylinder on the lower part of box to which it is inseparably connected by hinge flexed joint, made in the upper, higher part of the damper. On the lower part of the damper there is made a thorn for breaking through the aluminium foil. In starting position, the damper leans with the whole periphery against the internal shell of the internal cylinder, so that filling up the other box depends fully on it and not on aluminium foil under it. To the upper surface of damper there is inseparably connected the one-arm vertical flexible lever in form of a support of uniform thickness and changeable cross-section, which upper free end is in starting position a bit lower than the edge of the upper opening of the box. Inseparable bonds of a dumper with the box and lever with the damper are achieved in tools for pressure injection of the box of polymer materials so that in technological sense, all of them represent one part.

The cover has basically the form of a shallow glass with projecting bottom. On the internal shell of a cover there is made the thread for winding up the cover to the box of the cap. On opening of the cap there is made a ring remaining on the box at winding off the cover from the box of a cap as indicator of openness of the box. On the internal plane of the bottom of cover there is made a thin, low ring concentric to the shell of cover by which the cover, because of sealing, seats tightly to the internal shell of opening of the box. On one half of the internal plane of the bottom of cover, there are made two vertical concentric thin semicircular tangs forming a channel through which there is moving the top of a lever for opening the damper at winding up the cover to the box. Transversally to the internal shell of the external semicircular tang there is made a vertical barrier. When winding off the cover from the box, the top of lever for opening the damper glides along the external shell of the external semicircular tang up to the barrier. When the top of the lever for opening the damper leans against the barrier, it starts to bend a free end of the lever. By further winding off the cover, the barrier bends a free end of the lever more and more, creating a moment of force takes action on the damper. When this moment creates the force sufficient for tearing the bond of a damper with the box and mastering the resistance in the hinge of the damper, it starts to rotate round the hinge to the final open position in which it is held back by two teeth on the internal shell of the box. At rotation, the damper firstly breaks with the thorn through the aluminium foil below it and then it splits the same and removes by its edge, creating permanent opening which surface is larger than the half of the surface of cross-section of the internal cylinder of the box. In fully open position, the top of the lever is pressed to the internal shell of the box, so that after full winding off the cover from the box, through its opening one can drink the blend developed by mixing substances from the first and second box.

The essence of the invention is contained in constructional solution of functional and cost-effective mechanism for removing the partition between the first and second box by which forces and motions are transmitted from manually activated member of a mechanism to the cutting member of this mechanism. In the case in question, by manual winding off a cover of the box of the cap through the lever of a damper, it is taken action to the damper which is rotated round a hinge and which by breaking through and splitting, removes the aluminium foil.

In relation to solutions described in the state of the art in patent documents of the first and second group of solutions according to the invention, there are neither structural nor kinematic similarities.

In solutions described in the state of the art in patent documents No. WO2004000667 and WO2004033336 belonging to the third group of known solution, a cutting member is activated by winding off the manually activated member of a mechanism, as in the solution according to the invention as well. However, in both of these solutions, transmission of motion of the cover on the helix in motion of the cutting member is achieved through the complex system of inclinations, guides and stoppers, made on more parts of the mechanism. In the solution according to the invention conversion of motion of the cover on the helix in rotational motion of the cutting member is done by means of the lever as the simpliest machine element for force and motion transmission. In the solution according to the invention, the cutting member has a role of additional mechanical partition, relieving the aluminium foil as a basic impermeable partition which cutting elements in known solutions can not perform. Described constructional differences make the solution according to the invention easy and reliable for use and cost-effective for production, which is not achieved by any of known solutions described in the state of the art.

DESCRIPTION OF THE EMBODIMENT

The cap for bottles with the box for powder material for preparation of beverages is the cap by which the first or basic box is closed with the first or basic substance and which contains the second box with the other or additional substance. Both boxes are used for packing components of food, pharmaceutical or chemical products of which there is made the blend of these two components.

Figure 1:
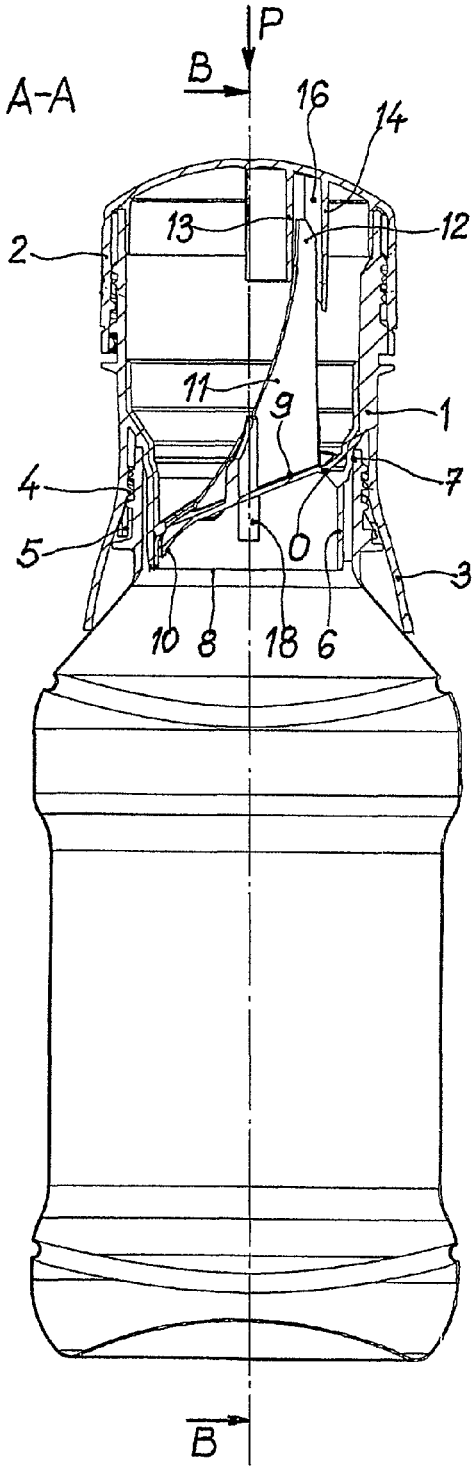
FIG. 1 shows longitudinal cross-section A-A from FIG. 2 of the bottle with the cap with radial plane of symmetry vertical to the rotation axis of the damper, where the cap with the box for the powder material is fully closed.
Figure 2:
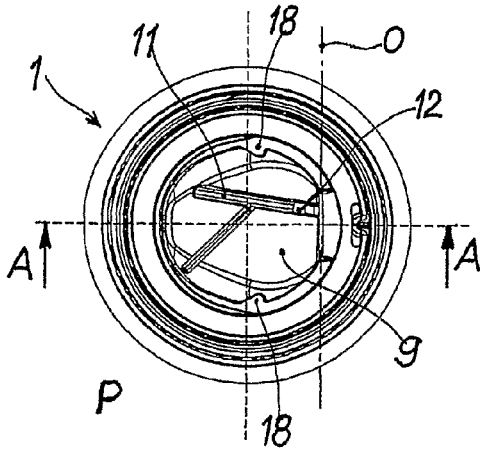
FIG. 2 shows the view P from FIG. 1 on the open box for powder material with closed damper.
Figure 3:
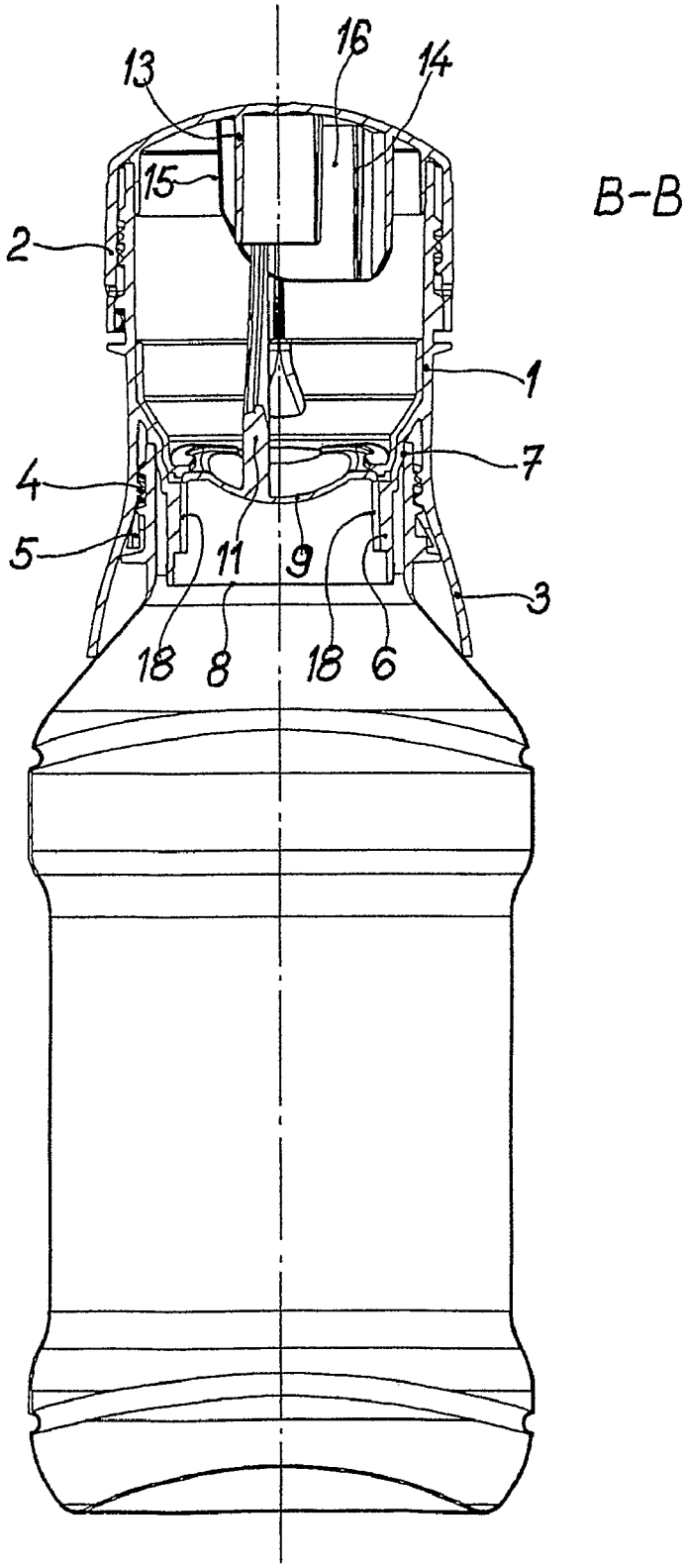
FIG. 3 shows longitudinal cross-section B-B from FIG. 1 of the bottle with the cap, with radial plane of symmetry parallel with the rotation axis of the damper, where the cap with the box for powder material is fully closed.
Figure 6:
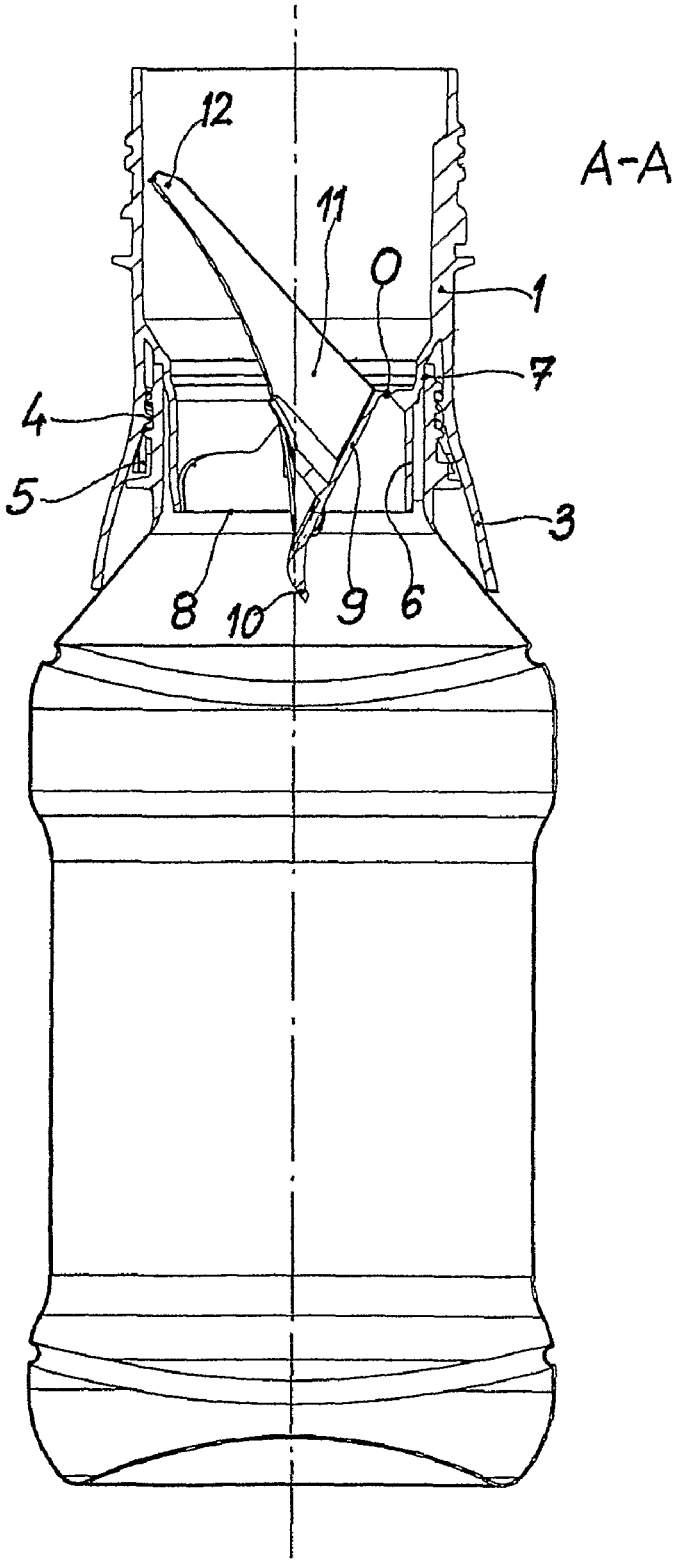
FIG. 6 shows longitudinal cross-section A-A from FIG. 2 of the bottle with the cap without a cover with radial plane of symmetry vertical to the rotation axis of the damper which is in fully open position in the state for drinking the blend.

The first or basic box has most frequently the form of a bottle for liquid shown on FIGS. 1, 3 and 6.

The cap for bottles according to the invention, shown on FIGS. 1 and 3, makes a system consisting of the second box 1 and its cover 2.

The box 1 of the cap has basically the form of a tube having in the lower half the form of double cylinder, integrating in one. In the lower part of the box 1 there is made the screwed-joint of the box 1 with the basic box enabling winding up the box 1 on the basic box, achieving impermeable joint of the box 1 with the basic box and which prevents winding off the box 1 from the basic box.

Screwed-joint of the box 1 with the basic box is made on the external cylinder 3 of the box 1. On the internal shell of the external cylinder 3 there are threads 4 for winding up the box 1 on the opening of the basic box. Below the thread 4 there are made flexible teeth 5 for preventing winding off the box 1 from the basic box. When winding up the box 1, overhangs made on the basic box enable teeth 5 to cross them, whereas at winding off the box 1, the teeth 5 stick to these overhangs which make impossible winding off the box 1. On the top of the external shell of the internal cylinder 6 there is a sealing surface 7, by which the box seats tightly on the upper part of the internal shell of opening of the basic box. This seat ensures permanent and impermeable joint of two boxes enabling drinking liquid through opening of the box 1 after mixing components in the basic box.

The box 1 is closed on the lower side by aluminium foil 8 which is impermeably glued on the edge itself of the opening and a part of the external shell of the internal cylinder 6.

In the internal cylinder 6 there is the cutting member in form of slant damper 9, arranged above the aluminium foil 8. The damper 9 has the form of ellipsoid plate of uniform thickness, obtained by section of the internal shell of the internal cylinder 6 with the plane, which under sharp angle in relation to horizontal plane, closes internal cylinder 6 in the whole. In the upper part, the damper 9 is inseparably connected with hinge bending joint with the rotation axis O to the internal shell of the internal cylinder 6, round which it can be rotated down towards the aluminium foil 8. On the lower part of the damper 9 there is made a thorn 10 for breaking through the aluminium foil 8. In starting position, the damper leans against the internal shell of the internal cylinder 6 with its whole periphery, so that filling up the box 1 depends on it in the whole and not on the aluminium foil 8 under it. To the upper surface of the damper 9 it is inseparably connected with one-arm vertical flexible lever 11 in form of a support with uniform thickness and changeable cross-section, which top 12 has rectangular cross-section, in starting position a bit lower from the edge of the upper opening of the box 1. Inseparable joints of the damper 9 and the box 1 and the lever 11 with the damper 9 are achieved in tools for pressure injecting the box 1 of polymer materials so that in technological sense, they all together represent one part.

The box 1 is closed on the upper part with the cover 2. On the upper part of the box 1, there is made the known screwed joint of the cover 2 with the box 1, enabling achieving impermeable joint of the box 1 with the cover 2 and indication of wound off position of the cover 2. The cover 2, more in detail shown in FIG. 4 and FIG. 5, has basically the form of shallow glass with projecting bottom. On one half of the internal plane of the bottom of the cover 2 there is made the internal, vertical semicircular tang 13 and external, vertical semicircular tang 14 which end 15 is in a straight line bent towards the axis of the cover 2. A tang 13 and a tang 14 are to a larger part mutually concentric and make the channel 16 through which, at winding up the cover 2 to the box 1, the top 12 of the lever 11 moves on the course bordered by two hatched circles on FIG. 4. Transversally on the external shell of the tang 14 there is made a vertical barrier 17.

Figure 4:
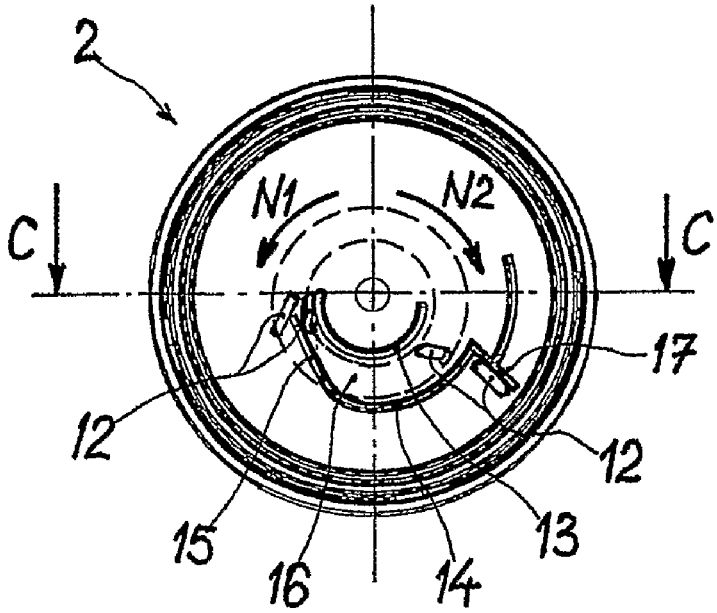
FIG. 4 is the view from the lower side on the cover of the box for powder material from FIG. 3.
Figure 5:
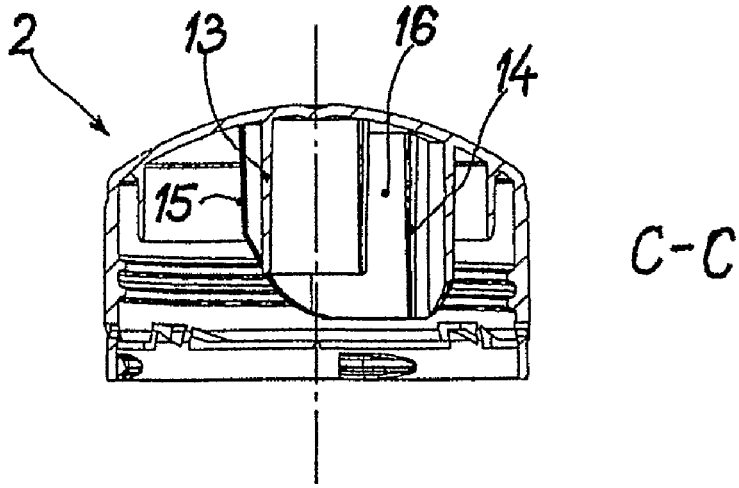
FIG. 5 shows longitudinal cross-section C-C of the cover of the box for powder material from FIG. 4.

FIG. 4 shows schematically a relative motion of the top 12 by presentation of its four characteristic positions in relation to the cover 2. The figure simulates motion of a top 12, whereas in reality, the cover 2 is moving. In relation to the box 1 resp. top 12 that are resting, the cover 2 during winding up on the box 1 rotates in direction N1, whereas during winding off from the box 1 it rotates in direction N2. During winding up the cover 2 on the box 1 the top 12 of the lever 11 enters the channel on the right, wider side of the channel 16 and comes out on the left, narrower side of the channel 16. At passing the entrance, wider part of the channel 16 which has the uniform width, the top 12 does not touch tangs 13 and 14. At passing the outgoing, narrowed part of a channel 16, the end 15 of the tang 14 forces the top 12 having rectangular cross-section, to turn, sliding on the tang 13, in order that its smaller side with rectangular cross-section could pass the outgoing part of a channel 16, whereby the lever 11 is elastically burdened to twisting. At the moment of leaving the outgoing part of the channel 16, elastically twisted lever 11 returns to original state which is felt as a twitch accompanied by sound effect. As the screwed joint of the cover 2 with the box 1 has more threads, at each going out the top 12 from the outgoing part of the channel 16 there is felt a twitch accompanied by sound effect which may be used as the indicator of good working order of the system of the box 1 and the cover 2. The cover 2 should be wound up on the box 1 to the last as shown in FIG. 1, in order to ensure impermeability of their joint and in order to bring the ring for indication of the state of wound off state of the cover 2, in functional state. At fully wound up cover 2 on the box 1, the top 12 of the lever enters the channel 16 the deepest, which enables a longer course of touch between the top 12 and the tag 14 with barrier 17 in course of winding off the cover 2 from the box 1.

Manual winding off the cover 2 from the box 1 wound up on the basic box should be done in a way, that the box 1 is held with one hand and kept below the cover 2 and to wind off the cover 2 with the other hand. Procedure of breaking through and removing the aluminium foil 8 takes place simultaneously with the starting part of procedure of opening the box 1, resp. winding off a fully wound up cover 2 from the box 1. Transmission of curved motion of the cover 2 to twisting motion of the damper 9 takes place through the lever 11. At the beginning of winding off of fully wound up cover 2 from the box 1, the top of the end 15 of a tang 14, it comes the top 12 of the lever 11 which elastically bends and directs to slide on the external shell of the tang 14 up to the barrier 17. By further winding off the cover 2, the barrier 17 bends elastically the free end of the lever 11 more and more, creating thus the moment of force which is transmitted through the lever 11 to the damper 9. When this moment has created a force sufficient for tearing joints of the damper 9 with the internal shell of the internal cylinder 6 and overcoming the resistance in the hinge of the damper 9, it starts to twist round the axis of rotation O, so that its thorn 10 twists towards the aluminium foil 8. At the beginning the thorn 10 breaks through the aluminium foil 8 and in further twisting the damper 9 removes with its edges the aluminium foil 8, creating a permanent opening which surface is larger than the half of the surface of transversal cross-section of the internal cylinder 6 of the box 1. In the final open position, the damper 9 sticks with its side edges in two teeth 18 made on the internal shell of the internal cylinder 6, keeping it permanently in this position. Together with the damper 9 the lever 11 twists also, which upon exiting the clutch with the barrier 17, remains pressed to the internal shell of the box 1, so that after complete winding off the cover 2 from the box 1, the blend obtained by mixing substances from the basic and second box 1, could be drank through its opening. Position of the damper 9 with the lever 11 upon opening the aluminium foil 8 is shown on FIG. 6.

For full opening the damper 9 and removing the aluminium foil 8 it is necessary to twist the cover 2 from fully wound up position for the angle smaller than a full circle, because the contact of the lever 11 with the tang 14 and barrier 17 takes place on the twisting angle approximately equal to the half of the circle. At the moment when the top 12 of the lever 11 comes out of the clutch with the barrier 17, flexibly bended lever 11 returns to the original state which is felt like a twitch accompanied by sound effect. This is the indicator that the damper 9 is in fully open position and that the process of mixing substances in boxes, started. In course of mixing substances from the box 1 with the substance in the basic box, it may come to the reaction that may cause creation of gases and foaming of a blend. In such an case winding off the cover 2, for which complete winding off more full rotations should be done, should be interrupted for a short time and to wait the completion of the process of degasification and foaming of the blend. In case if this process would be so strong that it causes leakage of the blend below partly wound off cover 2, it is possible to wind up the cover 2 on the box 1 in order to prevent the leakage of the blend, whereby parts of the cover 2 and the lever 11 do not come into consideration. Upon termination of the reaction of mixing substances in boxes, the cover 2 may be completely wound off and the blend from the basic box can be drunk through the opening of the box 1 of the cap, as shown in FIG. 6.

All described parts of this system are made of polymer materials, using technology of blowing and pressure injecting. The box 1 together with the damper 9 and the lever 11 is made with technology of pressure injecting as one part in relatively simple and cheap tools. The cover 2 is also made using technology of pressure injecting in relatively simple and cheap tools. Therefore the production price of the cap makes this constructional solution by market standards acceptable regardless of the fact that the complete cap together with the basic box is intended for the use as disposable cap, as highly serial product.

DESCRIPTION OF APPLICATION

The cap with the box for powder material according to the invention is developed for the needs of food industry, primarily for closing bottles in which there is performed packing drinking water and preparation of refreshing beverages directly before drinking, by means of powder materials packed separately in the box of the cap and drinking prepared beverages. Constructional solution of the cap enables packing other substances in other physical states as well, of which there are prepared blends of two substances directly before the use.

The invention claimed is:

1. A cap with a box of powder material for preparation of beverages, the cap being mounted on a bottle containing a first substance and closing the bottle, and substances contained in the bottle and the box of the cap are directly mixed before use, said cap comprising a cover, a tube having a lower half including a double cylinder, the double cylinder including an external cylinder and an internal cylinder connected together, an internal shell of the external cylinder having threads for winding the cap on an opening of the bottle located below the cap, the internal shell of the external cylinder having flexible teeth for preventing winding off of the cap from the bottle, a top of an external shell of the internal cylinder having a sealing surface by which the cap seats tightly on an upper part of the opening of the bottle, a bottom-side of the internal cylinder being closed with aluminum foil, impermeably glued to an edge of a part of the internal cylinder, the internal cylinder having a slant damper in a form of an ellipsoid plate of uniform thickness, developed from a section of an internal shell of the internal cylinder by a plane at a sharp angle in relation to a horizontal plane closing the internal cylinder, the slant damper being inseparably connected by a hinge bending joint to the internal shell of the internal cylinder, and the slant damper having, on a lower part a thorn for breaking through the aluminum foil, and the slant damper, in a final open position, being held by two teeth, arranged on the internal shell of the internal cylinder and the slant damper being inseparably connected to a one-arm vertical flexible lever in a form of a support of uniform thickness and changeable cross-section, a top of the slant damper having a rectangular cross-section, and on one half of an internal plane of a bottom surface of the cover is located an internal, vertical centric semicircular tang and a partly concentric external, vertical semicircular tang, an end of the external tang being bent towards a central axis of the cover, a channel located between the internal tang and the external tang for receipt of a top of the lever, and a vertical barrier located on the external tang for engagement by the top of the lever.

2. The cap for a bottle according to the claim 1, wherein during winding of the cover on the bottle in a first direction, the top of the lever moves from an incoming wider part of the channel towards an outgoing, narrower part of the channel and during winding off of the cover from the bottle in a second, opposite direction, motion of the cover is transformed into twisting motion of the damper in a way that the top of the lever moves sliding on the external tang to the barrier which elastically bends the lever, creating in the lever a moment of force which twists the damper.

* * * * *